United States Patent [19]

Hull

[11] 4,081,868

[45] Apr. 4, 1978

[54] ARTICLE OF FURNITURE

[76] Inventor: James R. Hull, 10910 Kinross Ave., Los Angeles, Calif. 90024

[21] Appl. No.: 765,434

[22] Filed: Feb. 4, 1977

[51] Int. Cl.[2] ..... A47C 7/20

[52] U.S. Cl. ..... 5/12 R; 5/92; 297/422; 297/441

[58] Field of Search ..... 5/12, 82, 92; 297/113, 297/115, 118, 422, 440, 441, 456, 445; 312/258, 5, 6

[56] References Cited

U.S. PATENT DOCUMENTS

| | | | |
|---|---|---|---|
| 944,564 | 12/1909 | Lambert | 5/12 R |
| 2,564,915 | 8/1951 | Nelson | 297/441 |
| 2,913,029 | 11/1959 | Paton | 312/6 |
| 3,419,309 | 12/1968 | Smith | 297/456 |
| 3,426,367 | 2/1969 | Bradf ord | 5/82 |
| 3,543,310 | 12/1970 | Smith | 297/441 |

*Primary Examiner*—Casmir A. Nunberg

*Attorney, Agent, or Firm*—Keith D. Beecher

[57] ABSTRACT

An article of furniture in the form of a four-sided open-bottom couch or bed is provided, comprising a rectangular bottom frame and U-shaped side frames coupled to the bottom frame, the side frames having pieces of canvas or other suitable fabric supported thereby to constitute sides for the couch. The sides of the couch slant outwardly, and spaces are provided at each corner to permit access by the occupants to drinks, books, and the like which may be placed on the floor outside of the area circumscribed by the couch. A mattress may be placed in the bottom frame of the couch; and a rug, blanket or the like may be placed over the mattress. Cushions may be placed against the slanting sides of the couch. The bottom and side frames are readily demountable for compact and easy shipment and storage. The couch may be placed on a supporting platform, if so desired.

5 Claims, 7 Drawing Figures

ARTICLE OF FURNITURE

DETAILED DESCRIPTION OF THE ILLUSTRATED EMBODIMENT

Figure 1:
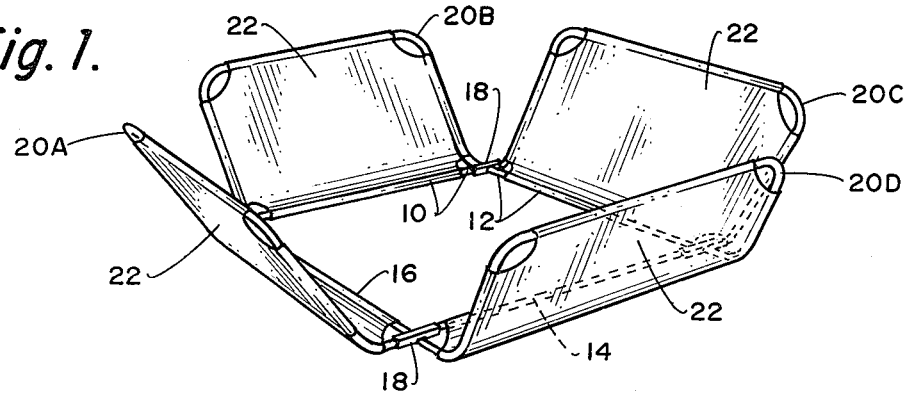
FIG. 1 is a perspective view of a couch representing one embodiment of the invention, taken from above and to one side of the couch.

The article of furniture of the present invention, as illustrated in the drawings, is in the form of a couch or bed having a rectangular bottom frame which is formed of four elongated members designated 10, 12, 14 and 16. These elongated members define an open bottom area for the couch. A length of tubing 18 is provided at each corner of the bottom frame formed by the elongated members, and the elongated members extend into the corresponding lengths of tubing in frictional engagement, so that the lengths of tubing constitute coupling means at each corner of the rectangular frame.

The couch also includes four U-shaped elongated members 20A, 20B, 20C, 20D which extend into corresponding ends of the lengths of tubing 18 in frictional engagement, to be supported in, or over, the lengths or tubing 18 so that each U-shaped elongated member defines a side frame slanting upwardly and outwardly from the plane of the bottom. A piece of canvas 22, or other appropriate material is stretched over each of the side frames formed by the elongated members.

The elongated members 10, 12, 14, 16, 20A–20D, may be tubular, and they may be composed, for example, of steel, and may be chrome plated or painted. Alternately, the elongated members could be formed of wood, or any other appropriate material.

Figure 2:
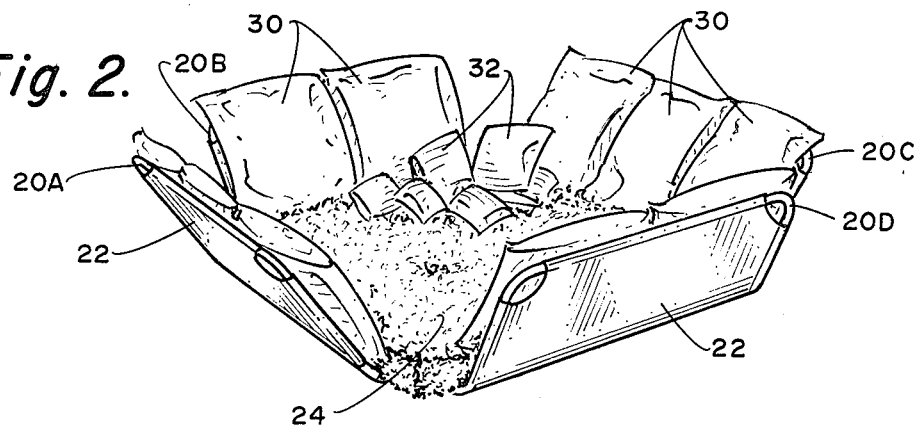
FIG. 2 is a view like FIG. 1 and showing blankets, cushions and pillows supported within the couch.

A mattress may be placed on the bottom area circumscribed by the rectangular bottom frame formed by the tubular members 10, 12, 14 and 16. A rug, such as the rug 24 in FIG. 2 may be placed over the mattress, and pillows and cushions, such as the pillows 30 and cushions 32 may be placed adjacent the sides of the couch, as also shown in FIG. 2.

Figure 3:
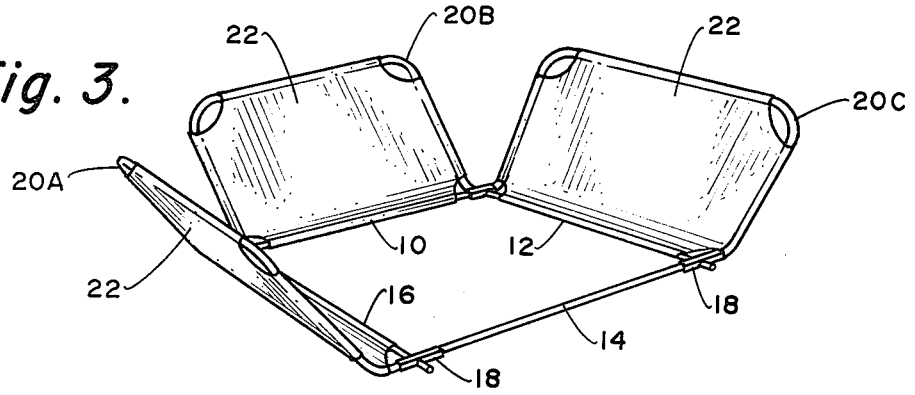
FIG. 3 is a view like FIG. 1, but with one side of the couch removed.
Figure 4:
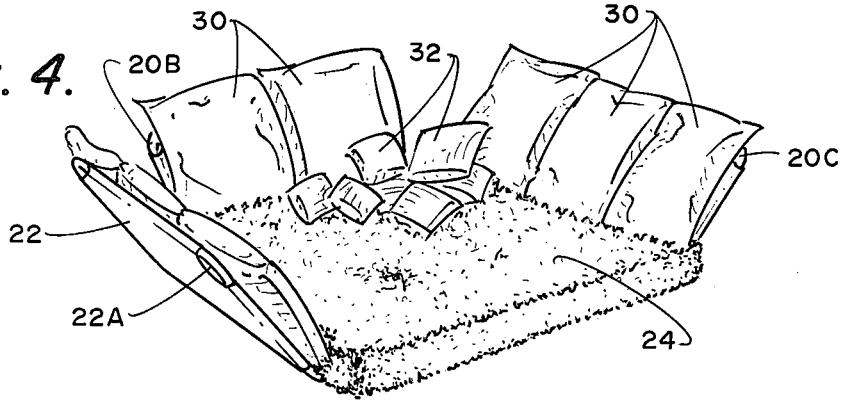
FIG. 4 shows the embodiment of FIG. 3 with pillows, cushions and blankets supported by the couch.

As shown in FIGS. 3 and 4, one of the side frames of the couch may be removed. Also, as mentioned above, the couch may be supported on a platform, up from the floor, if so desired.

Figure 5:
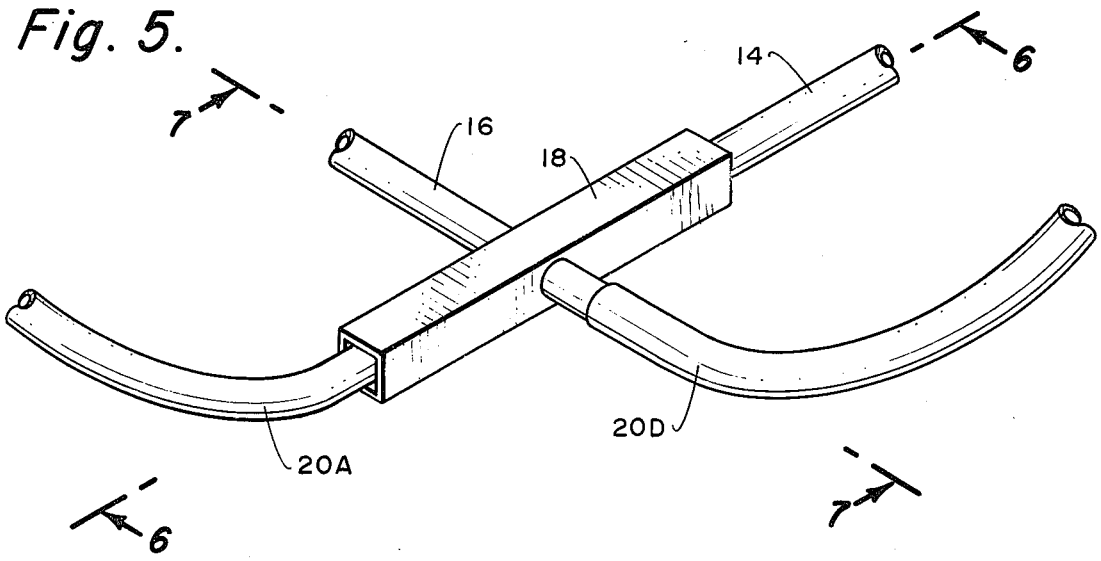
FIG. 5 is an enlarged perspective representation of one corner of the bottom frame of the couch of FIG. 1, and particularly illustrating coupling means for the tubular members which make up the bottom and side frames of the couch.
Figure 6:
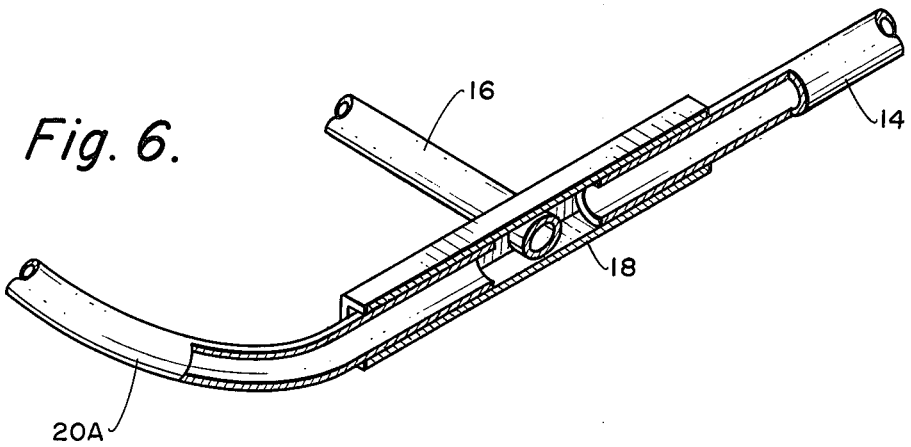
FIG. 6 is a section taken along the line 6—6 of FIG. 5.
Figure 7:
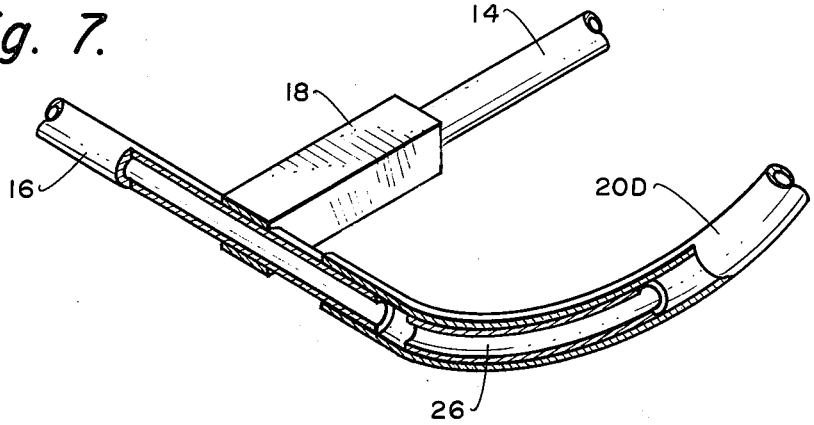
FIG. 7 is a section taken along the line 7—7 of FIG. 6.

The coupling means formed by the piece of tubing 18 is shown in more detail in FIGS. 5, 6 and 7. As illustrated, the piece of tubing 18 may be a square tubing with inner dimensions, for example, of 1 × 1 inch. The end of one of the tubular members 20 is received in one end of the tubing 18, and the end of the tubular member 14 of the first rectangular frame, for example, is received in the other end. Both the tubular members 14 and 20 may have an outer diameter, for example, of $\frac{7}{8}$ of an inch.

The ends of the tubular member 16 of the first frame extends, for example, transversely through the tubing 18, and the end of the tubular member 20D is received over the protruding end of tubular member 16. The internal diameter of tubular member 20D may for example, be 1 inch to receive the tubular member 16. A reinforcing tube 26 (FIG. 7) having an outer diameter, for example, of $\frac{7}{8}$ of an inch, may be supported within the end of the tubular member 20D.

The coupling assembly shown in FIGS. 5, 6 and 7 is convenient, in that it permits the frame rapidly to be assembled or disassembled, since it requires no pins or other fasteners. The various tubular members are frictionally supported within the length of tubing 18, and since the forces exerted on the various members are of a transverse nature, there is no tendency for the members to be pulled out of the coupling tubing.

The invention provides, therefore, an attractive article of furniture in the form of a couch or bed which may be conveniently shipped and stored, and which may easily be assembled or dissassembled, as desired.

While a particular embodiment of the invention has been shown and described, modifications may be made. It is intended in the claims to cover the modifications which come within the spirit and scope of the invention.

What is claimed is:

1. An article of furniture comprising: a rectangular bottom frame circumscribing a rectangular bottom area for the article; and plurality of side frames each comprising a U-shaped tubular member; coupling means connecting said side frames to said bottom frame to cause said side frames to define sides for the article slanting upwardly and outwardly from the plane of the bottom area; and pieces of fabric stretched over respective ones of the side frames and over respective ones of the portions of said bottom frame adjacent thereto.

2. The article of furniture defined in claim 1, which said coupling means comprises lengths of open-ended tubing, and each of the U-shaped tubular members comprising respective ones of said side frames has ends received in corresponding ends of the lengths of tubing comprising said coupling means.

3. The article of furniture defined in claim 2, in which the bottom frame includes a plurality of tubular members, and in which the ends of said tubular members of said bottom frame and the ends of the U-shaped tubular members of said side frames are frictionally supported in the lengths of tubing.

4. The article of furniture defined in claim 1, and which comprises four of said side frames respectively located at the four sides of said rectangular bottom frame.

5. The article of furniture defined in claim 4, in which the bottom frame is formed of four tubular members, and in which the ends of two of the tubular members of said bottom frame, and the ends of the tubular members of two of said side frames, extend into the ends of the lengths of said tubing, and the ends of the other two of the tubular members forming the bottom frame extends transversely through the lengths of said tubing telescopically to receive the ends of the tubular members of the other two of said side frames.

* * * * *